US008757743B2

(12) United States Patent
Wilson

(10) Patent No.: US 8,757,743 B2
(45) Date of Patent: Jun. 24, 2014

(54) SUPPORT SYSTEM FOR USE WITH AN APPLIANCE

(75) Inventor: Mark Wayne Wilson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 273 days.

(21) Appl. No.: 13/152,344

(22) Filed: Jun. 3, 2011

(65) Prior Publication Data

US 2012/0306336 A1 Dec. 6, 2012

(51) Int. Cl.
*A47B 96/04* (2006.01)

(52) U.S. Cl.
USPC ..... 312/408; 108/108; 211/103; 211/153; 248/241

(58) Field of Classification Search
USPC ..... 312/401, 406, 408; 108/106, 107, 108, 108/109, 110, 144.11, 147.11, 147.16, 108/147.17; 211/103, 187, 207, 90, 93, 211/133.4, 196, 205, 153; 248/235, 241, 248/242, 243, 244, 250
See application file for complete search history.

(56) References Cited

U.S. PATENT DOCUMENTS 3,264,049 A * 8/1966 Peterson ..... 312/304
3,726,578 A * 4/1973 Armstrong ..... 312/407
3,885,846 A * 5/1975 Chuang et al. ..... 312/306
4,170,335 A * 10/1979 King ..... 248/246
4,174,486 A * 11/1979 Winkler ..... 312/321.5
4,845,904 A * 7/1989 Menchetti ..... 52/36.6
4,901,965 A * 2/1990 Bowman ..... 248/246
5,074,422 A * 12/1991 Holtz ..... 211/187
6,062,401 A * 5/2000 Hall et al. ..... 211/187
7,611,111 B2 * 11/2009 Costa et al. ..... 248/243
2004/0255607 A1 * 12/2004 Barmann et al. ..... 62/407
2005/0162055 A1 * 7/2005 Bienick et al. ..... 312/408
2008/0246382 A1 * 10/2008 Kang et al. ..... 312/408
2010/0117502 A1 * 5/2010 Kang et al. ..... 312/408

OTHER PUBLICATIONS http://multimedia.b2b24.it/Flipit/ils_amb_0910140938/megazine/pdf/ils_amb_0910140938.pdf; Ambientecucina; Witnessing Styles and Trends; "A Luxury Version of Cold" 183 Anno 32 Aprile Maggio 2008; pp. 1 and 218-219.

* cited by examiner

*Primary Examiner* — Darnell Jayne
*Assistant Examiner* — Andres F Gallego
(74) *Attorney, Agent, or Firm* — Global Patent Operation; Marc A. Vivenzio

(57) ABSTRACT

A support system for use in an appliance includes at least one brace including a locking bar and at least one substantially vertical track configured to support the at least one brace. The at least one track includes a first side wall and a second side wall defining a channel therebetween, and a first series of teeth extending from the first side wall into the channel. The locking bar is configured to be supported at a first end on a tooth of the first series of teeth at a selected height within the appliance.

22 Claims, 6 Drawing Sheets

SUPPORT SYSTEM FOR USE WITH AN APPLIANCE

BACKGROUND OF THE INVENTION

1. Field of the Invention

The embodiments described herein relate generally to a shelving support system, and more particularly to a shelving support system that may be used within an appliance.

2. Description of Related Art

At least some known appliances, such as refrigeration appliances, include cantilevered shelves for supporting items within a storage compartment of the appliance. At least some of these shelves can be adjusted to different heights within the storage compartment by a user of the appliance. For example, some known shelves are removed from the storage compartment and re-attached into the storage compartment at a different height. In such known shelving systems, a series of holes into which the shelf can be coupled are visible when the storage compartment is accessed. Further, it can be difficult to re-attach a shelf to a set of holes at a desired height.

At least one other known cantilevered shelving system includes a track having relatively narrow notches defined along side walls of the track. A shelf is moveable along the track to different heights without being removed from the track. However, such notches may be difficult for the user to find and/or couple the shelf within when adjusting a height of the shelf. As such, the shelf may not be oriented properly within the storage compartment, i.e., not substantially horizontally oriented, and/or may not be completely seated within a notch, which may cause the shelf to become inadvertently disengaged from the notch.

BRIEF SUMMARY OF THE INVENTION

In one aspect, a support system for use in an appliance is provided. The support system includes at least one brace including a locking bar and at least one substantially vertical track configured to support the at least one brace at a plurality of user-selectable heights within the appliance. The at least one track includes a first side wall and a second side wall defining a channel therebetween, and a first series of teeth extending from the first side wall into the channel. Each tooth of the first series of teeth defines one height of the plurality of user-selectable heights. The locking bar is configured to be supported at a first end on any tooth of the first series of teeth.

In another aspect, an appliance is provided. The appliance includes at least one storage compartment including a plurality of interior walls at least partially defining a cavity of the at least one storage compartment and a door at least partially defining the cavity. The appliance further includes a support structure positioned within the cavity of the at least one storage compartment, and a support system coupled to at least one of at least one interior wall of the plurality of interior walls and the door. The support system includes at least one brace having a locking bar. The at least one brace is coupled to the support structure and configured to support the support structure within the at least one storage compartment. The support system further includes at least one substantially vertical track configured to support the at least one brace. The at least one track includes a first side wall and a second side wall defining a channel therebetween, and a first series of teeth extending from the first side wall into the channel. The locking bar is configured to be supported at a first end on a tooth of the first series of teeth at a selected height within the appliance.

In yet another aspect, a support system for use in an appliance including a plurality of interior walls at least partially defining a cavity of the appliance is provided. The support system includes a brace having a locking bar, and a substantially vertical track configured to couple within the cavity to support the brace within the cavity of the appliance. The track includes a first side wall and a second side wall defining a channel therebetween, and a first series of teeth extending from the first side wall into the channel. The locking bar is configured to be supported at a first end on a tooth of the first series of teeth at a selected height within the appliance.

In one aspect, an adjustable shelf support system for use in an appliance is provided. The support system includes at least one brace having a locking bar, and at least one substantially vertical track configured to support the at least one brace at a plurality of user-selectable heights within the appliance. The at least one track includes a first side wall and a second side wall defining a channel therebetween, and a first series of teeth extending from the first side wall into the channel. Each tooth defining one height of the plurality of user-selectable heights. The locking bar is configured to be supported on any tooth of the first series of teeth and is movably received in the channel. The brace is rotatable between an engaged position in which the locking bar is supported by one tooth of the first series of teeth and a disengaged position in which the locking bar is disengaged from the first series of teeth and free to move vertically in said channel to another selectable height of the plurality of user-selectable heights.

In another aspect, an adjustable shelf support system for use in an appliance is provided. The support system includes at least one brace having a locking bar, and at least one substantially vertical track configured to support the at least one brace at a plurality of selectable heights within the appliance. The at least one track includes a first side wall and a second side wall defining a channel therebetween, a first series of teeth extending from the first side wall into the channel, and a second series of teeth extending from the second side wall into the channel. Each tooth of the first series of teeth defines one height of the plurality of selectable heights. The locking bar is configured to be supported at a first end on any tooth of the first series of teeth. Each tooth of the second series of teeth is associated with a corresponding tooth of the first series of teeth to form a set of opposing support teeth. A second end of the locking bar is supported on the tooth of the second series of teeth corresponding to the tooth of the first series of teeth supporting the first end of the locking bar. The brace is movably received in the channel and rotatable between an engaged position in which the first end of the locking bar and the second end of the locking bar are supported by the set of opposing support teeth and a disengaged position in which the first and second ends of the locking bar are disengaged from the set of opposing support teeth and free to move vertically in the channel to another selectable height of the plurality of selectable heights.

In still another aspect, an appliance is provided. The appliance includes at least one storage compartment including a plurality of interior walls at least partially defining a cavity of the at least one storage compartment and a door at least partially defining the cavity. A support structure is positioned within the cavity of the at least one storage compartment, and a support system coupled to at least one interior wall of the plurality of interior walls and/or the door. The support system includes at least one brace having a locking bar. The at least one brace is coupled to the support structure and configured to support the support structure within the at least one storage compartment. The support system further includes at least one substantially vertical track configured to support the at least one brace. The at least one track includes a first side wall and a second side wall defining a channel therebetween and a first series of teeth extending from the first side wall into the channel. The locking bar is configured to be supported at a first end on a tooth of the first series of teeth at a selected height within the appliance. The locking bar is movably received in the channel and the brace is rotatable between an engaged position in which the locking bar is supported by one tooth of the first series of teeth and a disengaged position in which the locking bar is disengaged from the first series of teeth and free to move vertically in the channel to another selectable height.

BRIEF DESCRIPTION OF THE DRAWINGS

FIG. 1 is a front view of an exemplary appliance.

FIG. 2 is a cross-sectional side view of an exemplary support system that may be used with the appliance shown in FIG. 1.

FIG. 3 is a side view of an exemplary track that may be used with the support system shown in FIG. 2.

FIG. 4 is a side view of a first alternative track that may be used with the support system shown in FIG. 2.

FIG. 5 is a side view of a second alternative track that may be used with the support system shown in FIG. 2.

FIG. 6 is a side view of a third alternative track that may be used with the support system shown in FIG. 2.

FIG. 7 is a side view of a fourth alternative track that may be used with the support system shown in FIG. 2.

FIG. 8 is a side view of a fifth alternative track that may be used with the support system shown in FIG. 2.

FIG. 9 is a side view of a sixth alternative track that may be used with the support system shown in FIG. 2.

DETAILED DESCRIPTION OF THE INVENTION

The embodiments described herein provide a hidden cantilever shelf support system. The support system described herein enables a height of a shelf, or other suitable support structure, to be more easily adjustable as compared to known cantilever shelf support systems. More specifically, the height of a herein-described support assembly can be adjusted without removing the support assembly from a track, which has multiple, spaced-apart teeth that extend from a side wall into a channel. Further, the tracks described herein enable a support assembly to be secured into position on a tooth such that the support assembly is not inadvertently disengageable. The teeth of the tracks are easier for a user to find and position a support assembly thereon, as compared to tracks that include relatively narrow notches into which a shelf is positioned. More specifically, the support assembly seats more securely on the teeth, as compared to a shelf seated within a relatively narrow notch. As such, the embodiments described herein facilitate assuring that a support assembly will remain in a substantially horizontal alignment when seated.

Figure 1:
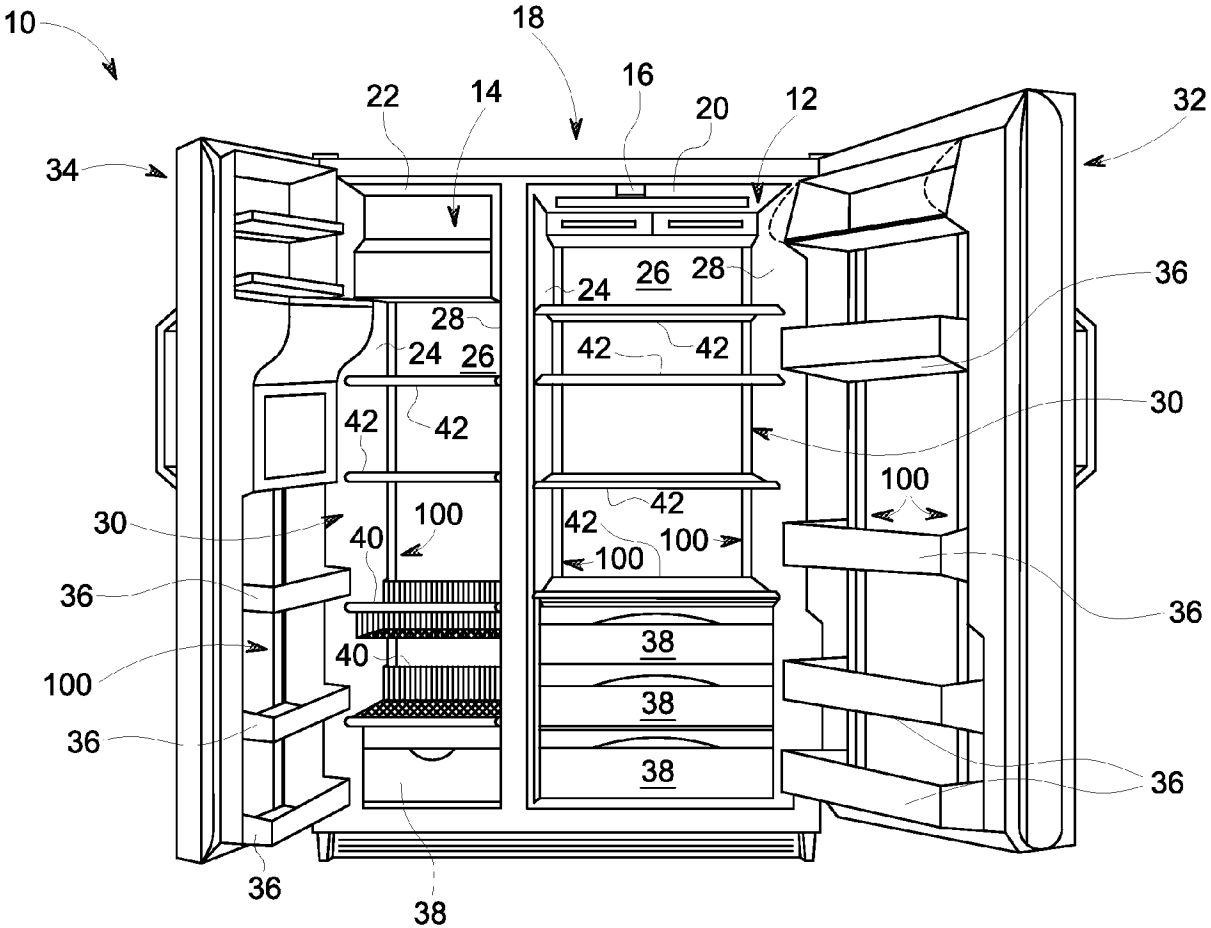
FIGS. 1-9 show exemplary embodiments of the apparatus and method described herein.

FIG. 1 is a front view of an exemplary appliance, such as a refrigeration appliance 10. Although refrigeration appliance 10 is described herein as a side-by-side refrigerator and freezer, it should be understood that the benefits of the embodiments described herein may be achieved in other types of refrigeration appliances, such as over-and-under refrigerators and freezers, stand-alone refrigerators, and/or stand-alone freezers. Further, it should be understood that the benefits of the herein-described embodiments may be achieved in other types of appliances.

In the exemplary embodiment, refrigeration appliance 10 includes a fresh food storage compartment 12, also referred to as a "refrigerator," and a freezer storage compartment 14. A controller 16 is mounted within refrigeration appliance 10, and is programmed to control temperatures within fresh food storage compartment 12 and/or freezer storage compartment 14. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

Refrigeration appliance 10 also includes a machinery compartment (not shown) that at least partially contains components for executing a known vapor compression cycle for cooling air. The components include, but are not limited to including, a compressor (not shown), a condenser (not shown), an expansion device (not shown), and an evaporator (not shown) connected in series and charged with a refrigerant. The evaporator provides cool air that is used to refrigerate fresh food storage compartment 12 and/or freezer storage compartment 14 via fans (not shown). Collectively, the vapor compression cycle components in a refrigeration circuit, associated fans, and associated storage compartments 12 and/or 14 are referred to herein as a "sealed system." The sealed system is operable to force cold air through refrigeration appliance 10.

In the exemplary embodiment, fresh food storage compartment 12 and freezer compartment 14 are positioned within an outer case 18 and include inner liners 20 and 22. Fresh food storage compartment 12 and freezer storage compartment 14 each include a plurality of interior walls, such as a first side wall 24, a rear wall 26, and a second side wall 28, formed from a respective inner liner 20 or 22. Walls 24, 26, and 28 at least partially define a cavity 30 of each storage compartment 12 and 14. The exemplary embodiment includes two separate inner liners 20 and 22 to add strength and to maintain manufacturing tolerances. Alternatively, a single liner is formed and a mullion extends between opposite sides of the liner to divide it into freezer storage compartment 14 and fresh food storage compartment 12.

A fresh food door 32 and a freezer door 34 close access openings to fresh food storage compartment 12 and freezer storage compartment 14, respectively, and at least partially define a respective cavity 30. Each door 32 and 34 is rotatable about its outer vertical end between an open position, as shown in FIG. 1, and a closed position (not shown) closing the associated storage compartment. Freezer door 34 includes at least one shelf/bin assembly 36, and fresh food door 32 also includes at least one shelf/bin assembly 36. Further, fresh food storage compartment 12 and freezer storage compartment 14 each includes slide-out drawers 38 to support items being stored therein. Further, freezer storage compartment 14 includes drawers 40 formed from a wire lattice. Alternatively, storage compartment 12 and/or 14 does not include drawers 38 and/or 40. In the exemplary embodiment, storage compartments 12 and 14 each include at least one shelf assembly 42.

In the exemplary embodiment, shelf assemblies 42 are supported within fresh food storage compartment 12 and/or freezer storage compartment 14 on at least one interior wall 24, 26, and/or 28 by a support system 100, as described in more detail below. Further, shelf/bin assemblies 36 are supported on door 32 and/or 34 using support system 100. Moreover, drawers 38 and/or 40 can also be supported by support system 100. Shelf assembly 42, shelf/bin assembly 36, and drawers 38 and 40 are referred to herein generally as a "support assembly" and/or a "shelf assembly". In the exemplary embodiment, support system 100 enables heights of each support assembly to be adjusted without removing the support assembly from support system 100. More specifically, support system 100 allows a support assembly to be slid upwards and/or downwards along support system 100 to a desired height.

Figure 2:
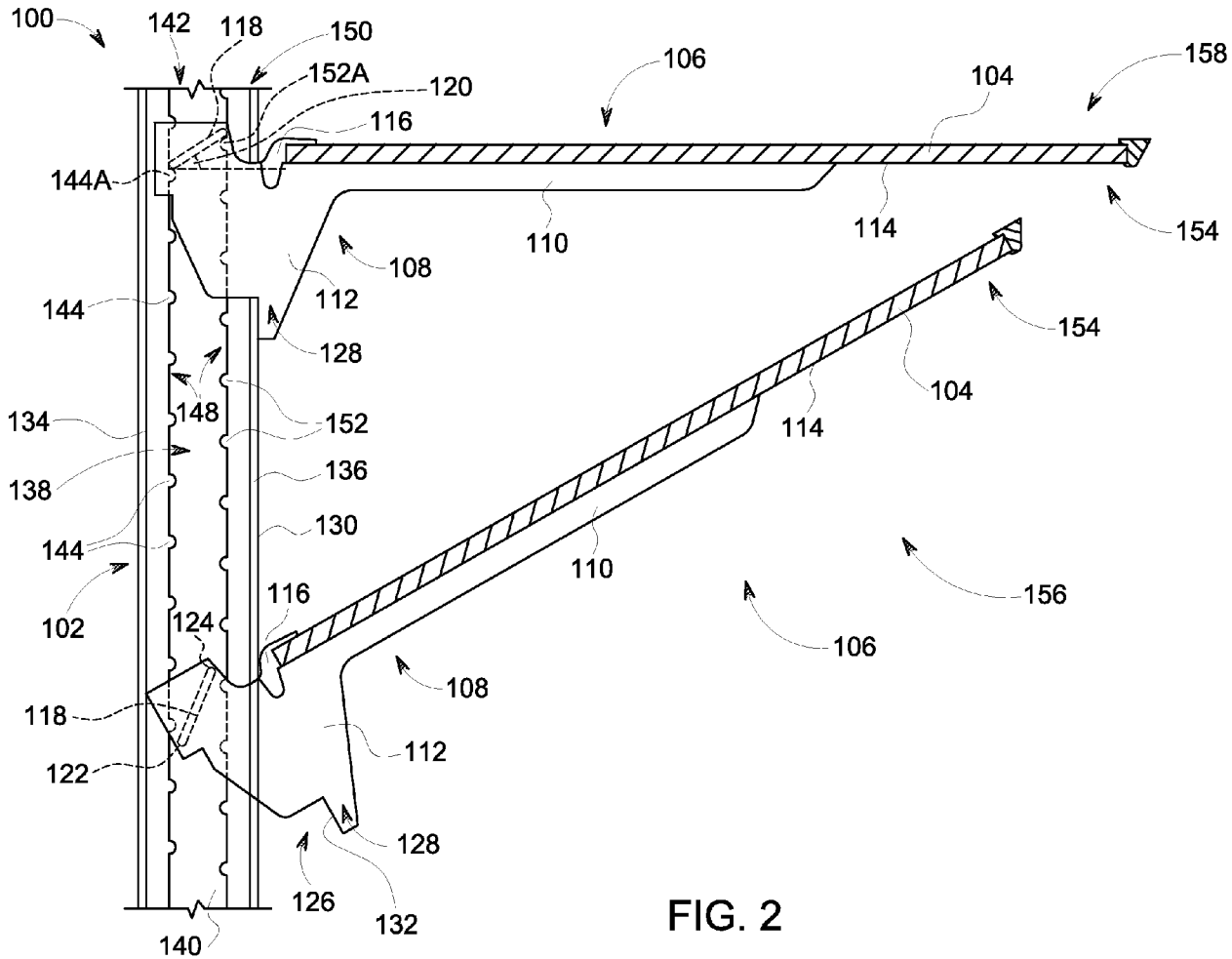
Figure 3:
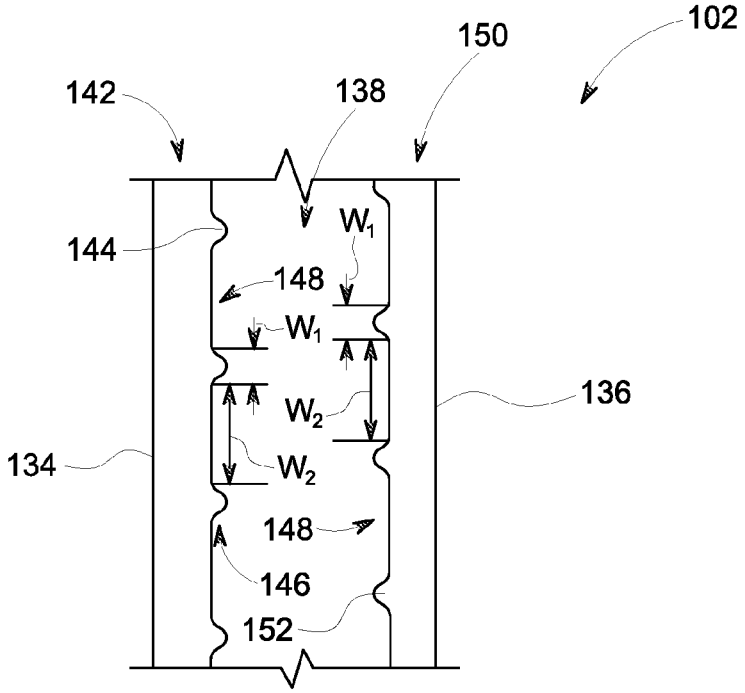

FIG. 2 is a cross-sectional side view of exemplary support system 100 that may be used with appliance 10 (shown in FIG. 1). FIG. 3 is a side view of an exemplary track 102 that may be used with support system 100. Support system 100 is configured to support at least one support structure, such as a shelf panel 104, a shelf/bin, and/or a drawer, within storage compartment 12 and/or 14 (shown in FIG. 1) at a selected height. As used herein, the term "selected height" refers a height selected by a user of appliance 10 and/or by any other suitable party. Further, for the sake of clarity, storage compartment 12 is referred to below; however, it should be understood that support system 100 can also be used within storage compartment 14. Additionally, a shelf panel 104 and a shelf assembly 106 are referred to herein; however, it should be understood that support system 100 can be used with any suitable support structure.

Support system 100 includes at least one brace 108 and at least one track 102. In the exemplary embodiment of FIG. 2, support system 100 includes a pair of braces 108 and a respective pair of tracks 102. Each brace 108 is configured to couple to a respective track 102, as described in more detail herein. Each track 102 is configured to couple to at least one interior wall 24, 26, and/or 28 (shown in FIG. 1) and/or door 32 and/or 34 (shown in FIG. 1). In the exemplary embodiment, tracks 102 are coupled to rear wall 26 proximate side ends of rear wall 26. Alternatively, or additionally, each track 102 is coupled to a respective side wall 24 or 28. In the exemplary embodiment, a support system 100, including track 102, is also coupled to each door 32 and 34, as shown in FIG. 1. Alternatively, a support system 100 is not coupled to door 32 and/or 34.

Brace 108 is configured to couple to shelf panel 104, or other suitable support structure, to support shelf panel 104 within cavity 30 (shown in FIG. 1) of storage compartment 12. At least one brace 108 coupled to shelf panel 104 forms a shelf assembly 106. More specifically, in the exemplary embodiment, a pair of braces 108 are coupled proximate to side ends of shelf panel 104 to form shelf assembly 106. Brace 108 includes a shelf support portion 110 and a vertical support portion 112. Portions 110 and 112 are formed integrally as one-piece; however, it should be understood that portions 110 and 112 can be separate components that are coupled together. In the exemplary embodiment, shelf support portion 110 is substantially perpendicular to vertical support portion 112 and is configured to support shelf panel 104 thereon. When brace 108 is coupled to shelf panel 104, shelf support portion 110 extends along a lower surface 114 of shelf panel 104. A retainer 116 is used to couple shelf panel 104 to brace 108. Alternatively, or additionally, any suitable method, technique, and/or component is used to couple shelf panel 104 to brace 108.

Brace 108 includes, in the exemplary embodiment, a locking bar 118. More specifically, locking bar 118 extends from vertical support portion 112, and is formed integrally as one-piece with vertical support portion 112 or coupled to vertical support portion 112. Locking bar 118 is oriented at any suitable angle 120, other than a 0° or 90° angle, with respect to shelf support portion 110. From simple geometry, a 90° angle will cause a vertical locking bar which may not properly lock. As such, any angle between 0° and 90° is selected to enable locking bar 118 to lock. The closer angle 120 is to 90°, the less rotation is used to disengage brace 108. Conversely, the closer angle 120 is to 0°, the more rotation is used to disengage brace 108. Tuning angle 120 between 0° and 90° can yield the desired amount of shelf rotation to disengage brace 108 from track 102. In the exemplary embodiment, angle 120 is between about 15° and about 30°. Further, locking bar 118 includes a first end 122 and a second end 124 and is substantially rectangular with rounded ends 122 and 124. In an alternative embodiment, end 122 and/or 124 includes a substantially flat surface. Alternatively, locking bar 118 has any suitable shape that enables support system 100 to function as described herein, such as trapezoidal, parallelogram-shaped, oval, elliptical, and/or polygonal.

Vertical support portion 112 further includes a notch 126 defined proximate a bottom 128 thereof. Notch 126 is configured to enable brace 108 to be supported against an outer surface 130 of track 102. More specifically, a substantially vertical surface 132 of notch 126 is configured to be at least partially in contact with outer surface 130 of track 102 when shelf panel 104 is oriented substantially perpendicular to track 102, as described in more detail herein below.

Track 102 is substantially vertically oriented within storage compartment 12 and is configured to support at least one brace 108. As such, track 102 is configured to support shelf assembly 106 within storage compartment 12. When storage compartment 12 includes a plurality of shelf assemblies 106, track 102 supports a plurality of braces 108. Track 102 is substantially continuous along a height of storage compartment 12; however, track 102 can include a plurality of non-continuous segments along the height of storage compartment 12. In the exemplary embodiment, track 102 includes a first side wall 134 and a second side wall 136 defining a channel 138 therebetween. First side wall 134 and second side wall 136 are connected by a connecting structure 140, such as a wall and/or cross-braces. Channel 138 is configured to receive locking bar 118 therein. When locking bar 118 is positioned within channel 138, brace 108 is vertically moveable along track 102.

A first series 142 of teeth 144 extend from first side wall 134 into channel 138. Teeth 144 are each substantially semicircular and extend from side wall 134 at a fillet 146. Alternatively, track 102 does not include at least one of the fillets 146, and at least one tooth 144 extends from side wall 134 at an angle. In the exemplary embodiment, each tooth 144 is configured to support first end 122 of locking bar 118 thereon. More specifically, locking bar 118 is configured to be supported at first end 122 on a selected tooth **144*a* of first series 142 of teeth 144 at a selected height within storage compartment 12 and/or appliance 10**.

Further, each tooth 144 of first series 142 of teeth 144 is spaced apart from an adjacent tooth 144 by an indentation 148. As such, track 102 includes a plurality of indentations 148 defined along first side wall 134 between adjacent teeth 144. Each tooth 144 has a first width $W_1$ and each indentation 148 has a second width $W_2$ that is wider than first width $W_1$. In the exemplary embodiment, a ratio of second width $W_2$ to first width $W_1$ is between about 5:1 and about 20:1.

A second series 150 of teeth 152 extends from second side wall 136 into channel 138. Each tooth 152 of second series 150 of teeth 152 is configured substantially similarly to each tooth 144 of first series 142 of teeth 144. Further, each tooth 152 of second series 150 is associated with a corresponding one of the teeth 144 of first series 142 and aligned relative to that tooth 144 to form a set of opposed support teeth, which engage and support locking bar 118 at the height defined by the vertical position of the set of support teeth. Generally, teeth 152 are aligned between adjacent teeth 144 of first series 142. In the exemplary embodiment, each tooth 152 is vertically aligned substantially half-way between its corresponding one of teeth 144 and the next lower one of teeth 144. Alternatively, teeth 152 may have any suitable alignment with respect to teeth 144 that satisfactorily engages and supports locking bar 118 when in the engaged position and provides sufficient clearance for satisfactory disengagement for convenient movement to a different selected height. In the exemplary embodiment, indentation 148 is defined between each set of adjacent teeth 152 and has second width $W_2$. As such, teeth 152 have substantially the same spacing as teeth 144. Alternatively, teeth 152 have a spacing that is different than the spacing of teeth 144.

The spacing of teeth 144 and/or teeth 152 is related to angle 120. More specifically, the spacing of teeth 144 relative to the spacing of teeth 152 sets angle 120 of rotation to disengage brace 108 for vertical motion. The tooth spacing is designed with locking bar angle 120 to set a desired amount of shelf rotation. In one embodiment, the amount of shelf rotation is small enough to ease adjusting the shelf position, but high enough rotation to prevent accidental disengagement of brace 108 from track 102.

In the exemplary embodiment, each tooth 152 of second series 150 is configured to support second end 124 of locking bar 118 thereon. More specifically, locking bar 118 is configured to be supported at second end 124 on a selected tooth 152*a* of second series 150 at the selected height within storage compartment 12 and/or appliance 10. Selected tooth 144*a* of first series 142 of teeth 144 and selected tooth 152*a* of second series 150 of teeth 152 upon which brace 108 is supported by locking bar 118 forms a set of opposing support teeth. A user of support system 100 can select any suitable opposing pair of a first series tooth 144 and a second series tooth 152 as the set of support teeth to achieve the user-selected height for the supported shelf.

More specifically, during use of support system 100, the user tilts a front end 154 of shelf panel 104 upward to rotate locking bar 118 toward a generally vertical orientation within channel 138 so as to disengage locking bar 118 from opposing pairs of support teeth. When shelf assembly 106 is sufficiently oriented, shelf assembly 106 is considered to be in a disengaged position 156 (shown at bottom of FIG. 2). Shelf assembly 106 is then free to slide vertically along track 102 to a different selected height within storage compartment 12 and/or appliance 10. At the new selected height, front end 154 of shelf panel 104 is then rotated downwardly to engage locking bar 118 with opposing pairs of teeth 144 and 152 at that vertical location. More specifically, first end 122 of locking bar 118 engages a tooth 144 of first series 142, and second end 124 of locking bar 118 engages a tooth 152 of second series 150. When shelf assembly 106 is oriented as such, shelf assembly 106 is considered to be in an engaged position 158 (shown at top of FIG. 2). Because locking bar 118 is oriented at angle 120, first end 122 of locking bar 118 is at a height that is lower than a height of second end 124 of locking bar 118 when shelf assembly 106 is in engaged position 158. Further, when shelf assembly 106 is in engaged position 158, brace 108 is configured to support shelf panel 104 in a substantially horizontal orientation.

When storage compartment 12 and/or appliance 10 includes a plurality of shelf assemblies 108, a plurality of shelf panels 104 are positioned at different heights within storage compartment 12. As such, each shelf panel 104 is supported on a different tooth 144 of first series 142 of teeth 144 and a different tooth 152 of second series 150 of teeth 152. Accordingly, each brace 108 is supported by a different set of support teeth.

Figure 4:
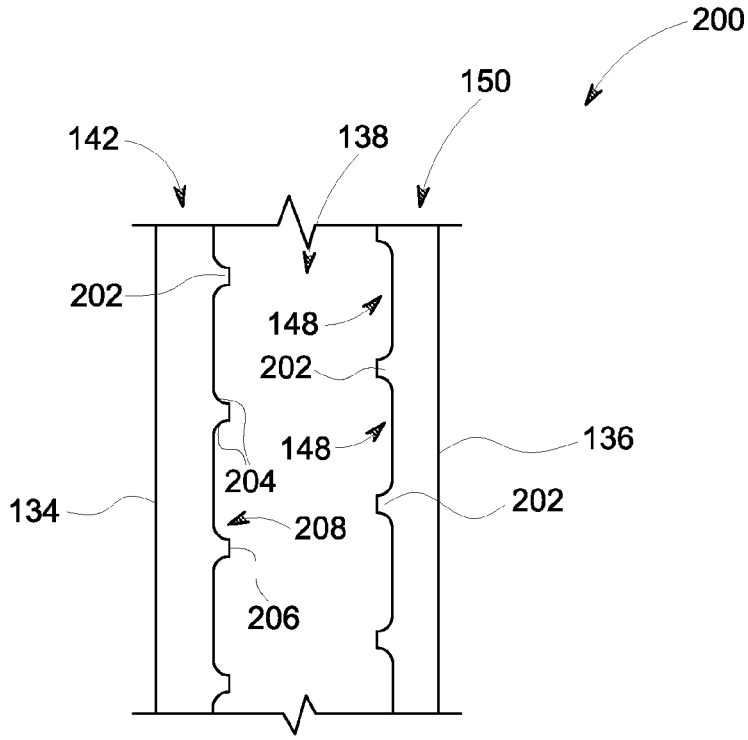

FIG. 4 is a side view of a first alternative track 200 that may be used with support system 100 (shown in FIG. 2). Track 200 is substantially similar to track 102 (shown in FIGS. 2 and 3), except track 200 includes substantially trapezoidal teeth 202, rather than including substantially semi-circular teeth 144 and/or 152 (shown in FIGS. 2 and 3). As such, components shown in FIG. 4 are labeled with the same reference numbers used in FIGS. 2 and 3. Track 200 may be substituted for track 102 within support system 100, and brace 108 (shown in FIG. 2) is supported within track 200, as described above.

In the exemplary embodiment, substantially trapezoidal teeth 202 each include two sides 204 and a substantially linear outer end 206. Sides 204 extend from side wall 134 and/or 136 at a fillet 208. End 122 and/or 124 (shown in FIG. 2) of locking bar 118 (shown in FIG. 2) is supported on a side 204 and/or fillet 208. Alternatively, track 200 does not include at least one of fillets 208, and at least one side 204 extends from side wall 134 and/or 136 at an angle.

Figure 5:
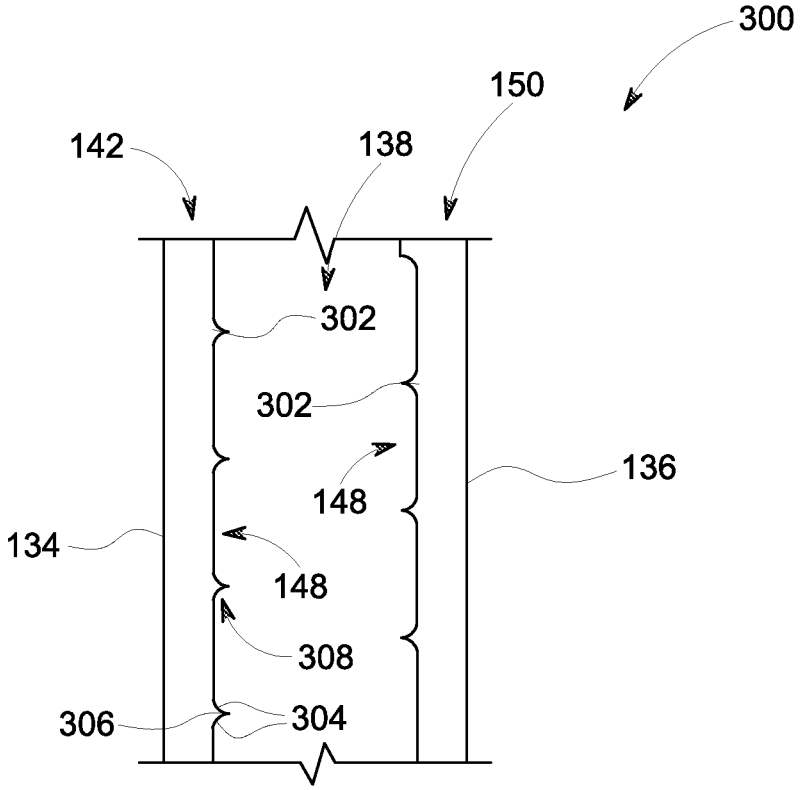

FIG. 5 is a side view of a second alternative track 300 that may be used with support system 100 (shown in FIG. 2). Track 300 is substantially similar to track 102 (shown in FIGS. 2 and 3), except track 300 includes substantially triangular teeth 302, rather than including substantially semi-circular teeth 144 and/or 152 (shown in FIGS. 2 and 3). As such, components shown in FIG. 5 are labeled with the same reference numbers used in FIGS. 2 and 3. Track 300 may be substituted for track 102 within support system 100, and brace 108 (shown in FIG. 2) is supported within track 300, as described above.

In the exemplary embodiment, substantially triangular teeth 302 are each shaped as a substantially equilateral triangle. More specifically, each tooth 302 includes two sides 304 that meet at an outer apex 306. Sides 304 each have substantially the same length. Sides 304 extend from side wall 134 and/or 136 at a fillet 308. End 122 and/or 124 (shown in FIG. 2) of locking bar 118 (shown in FIG. 2) is supported on a side 304 and/or fillet 308. Alternatively, track 300 does not include at least one of the fillets 308, and at least one side 304 extends from side wall 134 and/or 136 at an angle.

Figure 6:
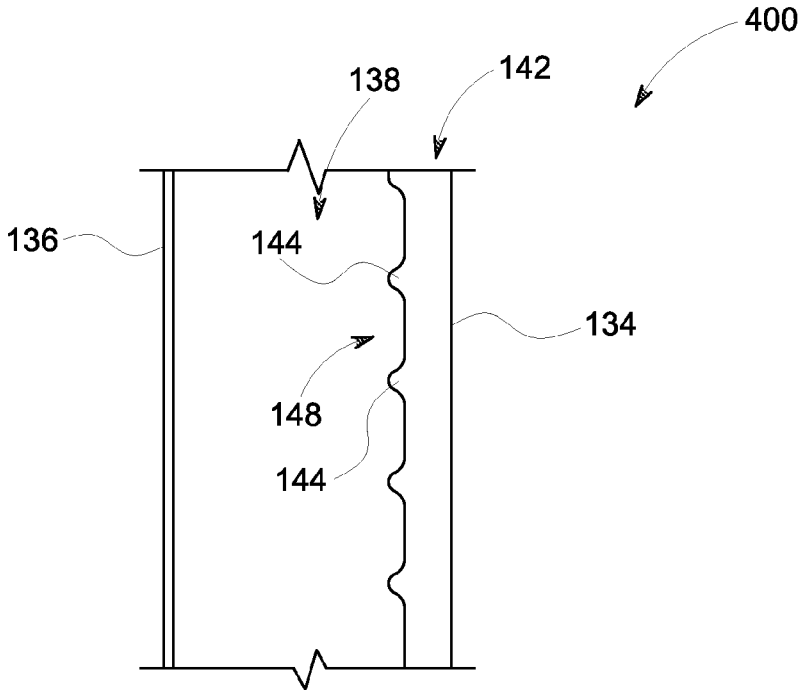

FIG. 6 is a side view of a third alternative track 400 that may be used with support system 100 (shown in FIG. 2). Track 400 is substantially similar to track 102 (shown in FIGS. 2 and 3), except track 400 includes one series 142 of teeth 144, rather than including two series 142 and 150 of teeth 144 and 152, respectively (shown in FIGS. 2 and 3). As such, components shown in FIG. 6 are labeled with the same reference numbers used in FIGS. 2 and 3. Track 400 may be substituted for track 102 within support system 100.

When track 400 is used with support system 100, first end 122 (shown in FIG. 2) of locking bar 118 (shown in FIG. 2) is supported on a tooth 144 of first series 142 of teeth 144, and second end 124 (shown in FIG. 2) of locking bar 118 is supported against second side wall 136. More specifically, second end 124 of locking bar 118 is supported within channel 138 by friction between second end 124 and second side wall 136. Alternatively, first end 122 of locking bar 118 is supported against first side wall 134, and second end 124 of locking bar 118 is supported on a tooth 152 (shown in FIGS. 2 and 3). In such an embodiment, track 400 includes one series 150 (shown in FIGS. 2 and 3) of teeth 152, rather than one series 142 of teeth 144.

Figure 7:
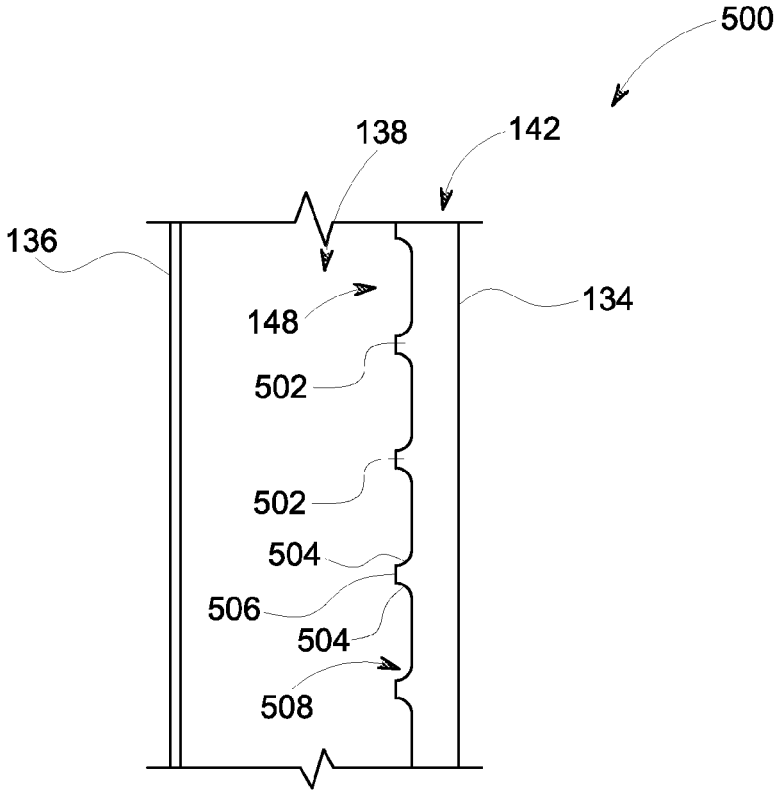

FIG. 7 is a side view of a fourth alternative track 500 that may be used with support system 100 (shown in FIG. 2). Track 500 is substantially similar to track 400 (shown in FIG.

6), except track 500 includes substantially trapezoidal teeth 502, rather than including substantially semi-circular teeth 144 (shown in FIG. 6) or 152 (shown in FIGS. 2 and 3). As such, components shown in FIG. 7 are labeled with the same reference numbers used in FIGS. 2 and 6. Track 500 may be substituted for track 102 within support system 100, and brace 108 (shown in FIG. 2) is supported within track 500, as described above with respect to FIG. 6.

In the exemplary embodiment, substantially trapezoidal teeth 502 each include two sides 504 and a substantially linear outer end 506. Sides 504 extend from side wall 134 or 136 at a fillet 508. End 122 or 124 (shown in FIG. 2) of locking bar 118 (shown in FIG. 2) is supported on a side 504 and/or fillet 506. Alternatively, track 500 does not include at least one of the fillets 508, and at least one side 504 extends from side wall 134 or 136 at an angle.

Figure 8:
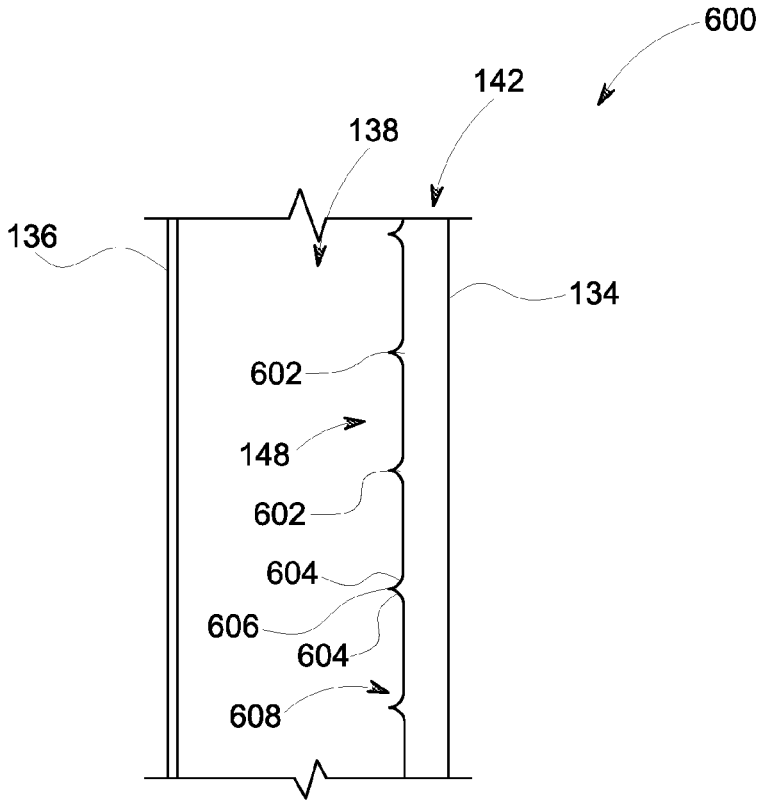

FIG. 8 is a side view of a fifth alternative track 600 that may be used with support system 100 (shown in FIG. 2). Track 600 is substantially similar to track 400 (shown in FIG. 6), except track 600 includes substantially triangular teeth 602, rather than including substantially semi-circular teeth 144 (shown in FIG. 6) or 152 (shown in FIGS. 2 and 3). As such, components shown in FIG. 8 are labeled with the same reference numbers used in FIGS. 2 and 6. Track 600 may be substituted for track 102 within support system 100, and brace 108 (shown in FIG. 2) is supported within track 600, as described above with respect to FIG. 6.

In the exemplary embodiment, substantially triangular teeth 602 are each shaped as a substantially equilateral triangle. More specifically, each tooth 602 includes two sides 604 that meet at an outer apex 606. Sides 604 each have substantially the same length. Sides 604 extend from side wall 134 or 136 at a fillet 608. End 122 or 124 (shown in FIG. 2) of locking bar 118 (shown in FIG. 2) is supported on a side 604 and/or fillet 608. Alternatively, track 600 does not include at least one of the fillets 608, and at least one side 604 extends from side wall 134 or 136 at an angle.

Figure 9:
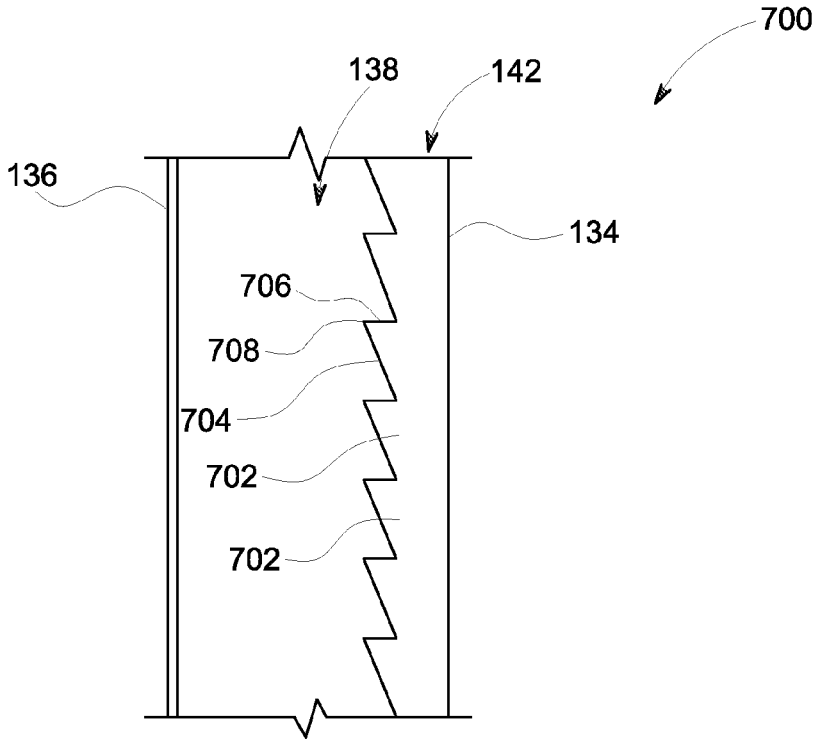

FIG. 9 is a side view of a sixth alternative track 700 that may be used with support system 100 (shown in FIG. 2). Track 700 is substantially similar to track 400 (shown in FIG. 6), except track 700 includes substantially triangular teeth 702, rather than including substantially semi-circular teeth 144 (shown in FIG. 6) or 152 (shown in FIGS. 2 and 3). As such, components shown in FIG. 9 are labeled with the same reference numbers used in FIGS. 2 and 6. Track 700 may be substituted for track 102 within support system 100, and brace 108 (shown in FIG. 2) is supported within track 700, as described above with respect to FIG. 6.

In the exemplary embodiment, substantially triangular teeth 702 are each shaped as a substantially right triangle. More specifically, each tooth 702 includes a first side 704 and a second side 706 that meet at an outer apex 708. First side 704 is longer than second side 706. Second side 706 is substantially perpendicular to side wall 134 and/or 136. End 122 or 124 (shown in FIG. 2) of locking bar 118 (shown in FIG. 2) is supported on a second side 706 of a selected tooth 702.

Referring to FIGS. 1-9, in a particular embodiment, support system 100 including track 102, 200, and/or 300 is coupled to at least one interior wall 24, 26, and/or 28, and support system 100 including track 400, 500, 600 and/or 700 is coupled to door 32 and/or 34. More specifically, track 400, 500, 600 and/or 700 is coupled to door 32 and/or 34 because tracks 400, 500, 600 and 700 are more narrow than tracks 102, 200, and 300 by including only one series of teeth. However, track 400, 500, 600 and/or 700 can be coupled to at least one interior wall 24, 26, and/or 28 and/or track 102, 200, and/or 300 can be coupled to door 32 and/or 34. Further, although in the exemplary embodiment one type of track is used on interior wall 24, 26, and/or 28 and a second type of track is used on door 32 and/or 34, all support systems 100 used within appliance 10 can include the same track 102, 200, 300, 400, 500, 600, or 700.

The embodiments described herein provide a support system for a support assembly that is easier to operate compared to known shelf support systems. More specifically, the above-described embodiments enable a height setting to be easily found and engaged because the tooth width is smaller than the indentation width. As such, the above-described embodiments enable a support assembly to be easily positioned at the height setting, as compared to known hidden shelf support systems that include relatively narrow notches. Further, the support assembly can be substantially horizontally aligned within a storage compartment, and the teeth described herein facilitate maintaining the substantially horizontal position of the support assembly. Moreover, the teeth and indentation locking arrangement enables smooth movement of the support assembly along the track compared to known hidden shelf support systems.

Exemplary embodiments of a support system for use with an appliance are described above in detail. The methods and systems described herein are not limited to the specific embodiments described herein, but rather, components of the systems and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A support system for use in an appliance, said support system comprising:

at least one brace comprising a locking bar; and at least one substantially vertical track configured to support said at least one brace at a plurality of user-selectable heights within the appliance, said at least one track comprising:

a first side wall, a second side wall, and a connecting structure defining a channel therebetween; and a first series of teeth extending from said first side wall into said channel and a second series of teeth extending from said second side wall into said channel, each tooth of said first series of teeth being associated with a corresponding tooth of said second series of teeth to form a plurality of sets of corresponding teeth facing each other, each set defining one of the plurality of user-selectable heights, wherein one tooth in each set of corresponding teeth is positioned lower along said at least one substantially vertical track relative to said other tooth in each set of corresponding teeth; and when said locking bar is supported by any set of said plurality of sets corresponding teeth, a first end of said locking bar is supported by one tooth of said set and a second end of said locking bar is supported by said other tooth of said set, wherein one of said first end and said second end of said locking bar is at a height along said at least one vertical track that is lower than a height of the other of said first end and said second end of said locking bar so that said locking bar extends between said first end and said second end at an oblique angle relative to said first side wall and said second side wall.

2. A support system in accordance with claim 1, wherein said at least one track further comprises a first plurality of indentations defined along said first side wall, each indentation of said first plurality of indentations defined between adjacent teeth of said first series of teeth, wherein each tooth of said first series of teeth has a first width and each indentation of said first plurality of indentations has a second width that is greater than the first width.

3. A support system in accordance with claim 2, wherein said at least one track further comprises a second plurality of indentations defined along said second side wall, each indentation of said second plurality of indentations defined between adjacent teeth of said second series of teeth, wherein each tooth of said second series of teeth has a first width and each indentation of said second plurality of indentations has a second width that is greater than the first width.

4. A support system in accordance with claim 1, wherein said second end of said locking bar is supported against said second side wall of said at least one track.

5. A support system in accordance with claim 1, wherein each tooth of said second series of teeth is configured substantially similarly to each tooth of said first series of teeth.

6. A support system in accordance with claim 1, wherein said at least one brace is configured to support a shelf panel in a substantially horizontal orientation when said first end of said locking bar is supported on said tooth of said first series of teeth.

7. A support system in accordance with claim 1, wherein said locking bar is movably receivable within said channel and said at least one brace rotatable between an engaged position in which said locking bar is supported by a set of corresponding teeth of said plurality of sets of corresponding teeth and a disengaged position in which said locking bar is disengaged from at least one tooth of said set of corresponding teeth of said plurality of sets of corresponding teeth and free to move vertically in said channel to another selectable height of said plurality of user-selectable heights.

8. An appliance, comprising:

at least one storage compartment including a plurality of interior walls at least partially defining a cavity of said at least one storage compartment and a door at least partially defining said cavity;

a support structure positioned within said cavity of said at least one storage compartment; and a support system coupled to at least one interior wall of said plurality of interior walls and said door, said support system comprising:

at least one brace comprising a locking bar, said at least one brace coupled to said support structure and configured to support said support structure within said at least one storage compartment; and at least one substantially vertical track configured to support said at least one brace, said at least one track comprising:

a first side wall, a second side wall, and a connecting structure defining a channel therebetween; and a first series of teeth extending from said first side wall into said channel and a second series of teeth extending from said second side wall into said channel, each tooth of said first series of teeth being associated with a corresponding tooth of said second series of teeth to form a plurality of sets of corresponding teeth facing each other, each set defining one of a plurality of selectable heights for positioning said support system within said appliance along said at least one substantially vertical track at which, wherein one tooth in each set of corresponding teeth is positioned lower along said at least one substantially vertical track relative to said other tooth in each set of corresponding teeth; and when said locking bar is supported by any set of said plurality of sets corresponding teeth, a first end of said locking bar is supported by one tooth of said set and a second end of said locking bar is supported by said other tooth of said set, wherein one of said first end and said second end of said locking bar is at a height along said at least one vertical track that is lower than a height of the other of said first end and said second end of said locking bar so that said locking bar extends between said first end and said second end at an oblique angle relative to said first side wall and said second side wall.

9. An appliance in accordance with claim 8, wherein said at least one track further comprises a first plurality of indentations defined along said first side wall, each indentation of said first plurality of indentations defined between adjacent teeth of said first series of teeth, wherein each tooth of said first series of teeth has a first width and each indentation of said first plurality of indentations has a second width that is greater than the first width.

10. An appliance in accordance with claim 9, wherein said at least one track further comprises a second plurality of indentations defined along said second side wall, each indentation of said second plurality of indentations defined between adjacent teeth of said second series of teeth, wherein each tooth of said second series of teeth has a first width and each indentation of said second plurality of indentations has a second width that is greater than the first width.

11. An appliance in accordance with claim 8, wherein said plurality of interior walls comprises a rear wall and said at least one track further comprises two tracks coupled to said rear wall proximate sides of said rear wall.

12. An appliance in accordance with claim 8, wherein said plurality of interior walls comprises a first side wall and a second side wall and said at least one track further comprises a first track coupled to said first side wall and a second track coupled to said second side wall.

13. An appliance in accordance with claim 8, wherein said at least one track is coupled to said door.

14. An appliance in accordance with claim 8, further comprising a plurality of support structures positioned at different heights within said cavity, each support structure of said plurality of support structures supported on a different tooth of said first series of teeth.

15. An appliance in accordance with claim 8, wherein said at least one track is continuous along a height of said at least one storage compartment.

16. An appliance in accordance with claim 8, wherein said locking bar is movably receivable within said channel and said at least one brace rotatable between an engaged position in which said locking bar is supported by a set of corresponding teeth of said plurality of sets of corresponding teeth and a disengaged position in which said locking bar is disengaged from at least one tooth of said set of corresponding teeth of said plurality of sets of corresponding teeth and free to move vertically in said channel to another selectable height of said plurality of user-selectable heights.

17. A support system for use in an appliance including a plurality of interior walls at least partially defining a cavity of the appliance, said support system comprising:

a brace comprising a locking bar; and a substantially vertical track configured to couple within the cavity to support said brace within the cavity of the appliance, said track comprising:

a first side wall, a second side wall, and a connecting structure defining a channel therebetween; and a first series of teeth extending from said first side wall into said channel and a second series of teeth extending from said second side wall into said channel, each tooth of said first series of teeth being associated with a corresponding tooth of said second series of teeth to form a plurality of sets of corresponding teeth facing each other, each set defining one of a plurality of selectable heights for positioning said support system within said appliance along said substantially vertical track at which, wherein one tooth in each set of corresponding teeth is positioned lower along said substantially vertical track relative to said other tooth in each set of corresponding teeth; and when said locking bar is supported by any set of said plurality of sets corresponding teeth, a first end of said locking bar is supported by one tooth of said set and a second end of said locking bar is supported by said other tooth of said set, wherein one of said first end and said second end of said locking bar is at a height along said vertical track that is lower than a height of the other of said first end and said second end of said locking bar so that said locking bar extends between said first end and said second end at an oblique angle relative to said first side wall and said second side wall.

18. A support system in accordance with claim 17, wherein said track further comprises a first plurality of indentations defined along said first side wall, each indentation of said first plurality of indentations defined between adjacent teeth of said first series of teeth, wherein each tooth of said first series of teeth has a first width and each indentation of said first plurality of indentations has a second width that is wider than the first width.

19. A support system in accordance with claim 18, wherein said at least one track further comprises a second plurality of indentations defined along said second side wall, each indentation of said second plurality of indentations defined between adjacent teeth of said second series of teeth, wherein each tooth of said second series of teeth has a first width and each indentation of said second plurality of indentations has a second width that is greater than the first width.

20. A support system in accordance with claim 17, wherein said brace is configured to be movable along said track when said locking bar is positioned within said channel.

21. A support system in accordance with claim 17, wherein each tooth of said first series of teeth is one of substantially semi-circular, substantially triangular, and substantially trapezoidal.

22. A support system in accordance with claim 17, wherein said locking bar is movably receivable within said channel and said brace rotatable between an engaged position in which said locking bar is supported by a set of corresponding teeth of said plurality of sets of corresponding teeth and a disengaged position in which said locking bar is disengaged from at least one tooth of said set of corresponding teeth of said plurality of sets of corresponding teeth and free to move vertically in said channel to another selectable height of said plurality of user-selectable heights.

* * * * *